US006045351A

United States Patent [19]

Döbbeling et al.

[11] Patent Number: 6,045,351

[45] Date of Patent: Apr. 4, 2000

[54] METHOD OF OPERATING A BURNER OF A HEAT GENERATOR

[75] Inventors: Klaus Döbbeling, Windisch; Christian Steinbach, Neuenhof, both of Switzerland

[73] Assignee: ABB Alstom Power (Switzerland) Ltd, Baden, Switzerland

[21] Appl. No.: 09/210,738

[22] Filed: Dec. 15, 1998

[30] Foreign Application Priority Data

Dec. 22, 1997 [DE] Germany ..... 197 57 189

[51] Int. Cl.[7] ..... F24C 5/00

[52] U.S. Cl. ..... 431/8; 431/10; 431/351; 431/353

[58] Field of Search ..... 431/350–354, 431/173, 8, 10, 12, 183, 185

[56] References Cited

U.S. PATENT DOCUMENTS 5,513,982 5/1996 Althaus et al. ..... 431/350
5,645,410 7/1997 Brostmeyer ..... 431/8
5,673,551 10/1997 Dobbeling ..... 431/350

FOREIGN PATENT DOCUMENTS

0321809B1 5/1991 European Pat. Off. .
0620362A1 10/1994 European Pat. Off. .
0780629A2 6/1997 European Pat. Off. .
2106074 8/1972 Germany .

*Primary Examiner*—James C. Yeung
*Attorney, Agent, or Firm*—Burns, Doane, Swecker & Mathis, L.L.P.

[57] ABSTRACT

In a method of operating a burner of a heat generator, in which the burner essentially includes a swirl generator for a combustion-air flow, a mechanism for injecting at least one fuel into the combustion-air flow, and a number of transition passages for passing a flow formed in the swirl generator into a mixing tube arranged downstream of the transition passages, a predetermined quantity of a second fuel having a good ignition quality is injected into the reaction zone in order to stabilize the combustion in the combustion space.

17 Claims, 6 Drawing Sheets

METHOD OF OPERATING A BURNER OF A HEAT GENERATOR

BACKGROUND OF THE INVENTION

1. Field of the Invention

The present invention relates to a method of operating a burner of a heat generator and in particular, to a burner including a swirl generator for providing a combustion-air flow, a mechanism for injecting at least one fuel into the combustion-air flow, and a mixing section having a number of transition passages for passing a flow formed in the swirl generator into a mixing tube, wherein a combustion-air/fuel mixture is obtained. It also relates to a burner for carrying out this method.

2. Discussion of Background

The low-pollution burners having a lean premix which are used at present for the operation of heat generators, for example combustion chambers of gas turbines, are stabilized aerodynamically by recirculation zones, for example vortex breakdown. This stabilization is based on the return transport of hot products of combustion, which serve as an ignition source for the lean fuel/air mixture. During such stabilization, the temperature of the recirculated products of combustion also decreases when the flame temperature is low, and thus the thermal energy transported into the reduction zone is no longer sufficient for activating the reaction. The consequence thereof is that the flame is extinguished.

During the development of premixed burners operated with a liquid fuel, it has been found that the extinction limit of the flame is reached only at substantially lower temperatures. Since the flame velocity of a liquid fuel, for example fuel oil, is lower than that of a gaseous fuel, for example natural gas, this effect can only be attributed to the lower activation energy in the case of long-chain hydrocarbons. In the case of liquid fuels, this results in self-ignition delay times which are substantially shorter than that of a gaseous fuel.

EP-0 620 362 A1 has disclosed a method in which the shorter self-ignition delay time is utilized. This method concerns the operation of a combustion chamber which is designed for self-ignition and in which, in order to ensure reliable self-ignition of the gaseous fuel injected into the combustion chamber, when the temperature drops below a certain level of the hot gases introduced there, action is taken by means of a small quantity of another fuel having a shorter self-ignition delay time. However, this action is taken in such a way as to be isolated from a defined premix section of a burner, so that the auxiliary fuel which is introduced can act here as an ignition fuse, so to speak. The risk of any kind of backflash of the flame need not be feared here, since there is no premix section having an intensely swirled flow.

In burners of the newer generation, however, as have been disclosed by EP-0 321 809 B1, EP-0 780 629 A2, the concern is to create recirculation-stabilized zones in order to extend the operating range having a lean premix flame. Since aerodynamic stabilization is effected here by an intensely swirled flow, the indiscriminate introduction of a fuel having shorter self-ignition delay times for improving the stability with respect to the extinction limit of combustion with a fuel having a poor ignition quality must not lead to the risk of a backflash of the flame being increased.

SUMMARY OF THE INVENTION

Accordingly, one object of the invention, in a method and a burner of the type mentioned at the beginning having extended low-pollution and lean premix operation, is to remove the risk of a backflash of the flame.

The shorter self-ignition delay time of most liquid fuels is utilized according to the invention in order to stabilize a premix burner by specific admixing of a small portion of a fuel having a good ignition quality, which premix burner is operated with a natural-gas/air mixture or another fuel/air mixture having a poor ignition quality, in particular by a very lean mixture of prevaporized oil with air. In this case, the premix section is dimensioned in such a way that, at the prevailing flow velocities and temperatures, self-ignition is safely ruled out on account of the ignition delay time in the premix section. In the reaction zone provided, the flow velocity, by a widening of cross section, is to be reduced to such an extent that, under all desired operating conditions, the retention time of the air/fuel mixture originating from the premix section exceeds the ignition delay time of a fuel having a good ignition quality and preferably injected into the reaction zone and thus achieves the desired reaction.

The energy released during the reaction of the fuel having a good ignition quality is sufficient in order to ignite the less reactive fuel/air mixture.

The essential advantage of the invention may be seen in the fact that this stabilization principle is used in recirculation-stabilized burners in order to extend the operating range having a lean premix flame. The greatest improvement during such stabilization can be achieved during direct injection with locally high fuel concentrations of the fuel having a good ignition quality into the reaction zone.

Since the modern premix burners (cf. the above publications) are designed for dual operation, the stabilization according to the invention can be achieved in these burners at a negligible cost.

This type of flame stabilization enables an extended, low-pollution, lean premix operation. The risk of a backflash of the flame into the premix section is eliminated, since no aerodynamic stabilization is effected there. Furthermore, the proposal according to the invention leads to a situation in which the otherwise conventional diffusion pilot systems are therefore omitted, which has a positive effect on efficiency and pollutant emissions.

Advantageous and expedient developments of the achievement of the object according to the invention are defined in the further claims.

Referring now to the drawings, wherein like reference numerals designate identical or corresponding parts throughout the several views, all features not essential for the direct understanding of the invention have been omitted, and the direction of flow of the media is indicated by arrows.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
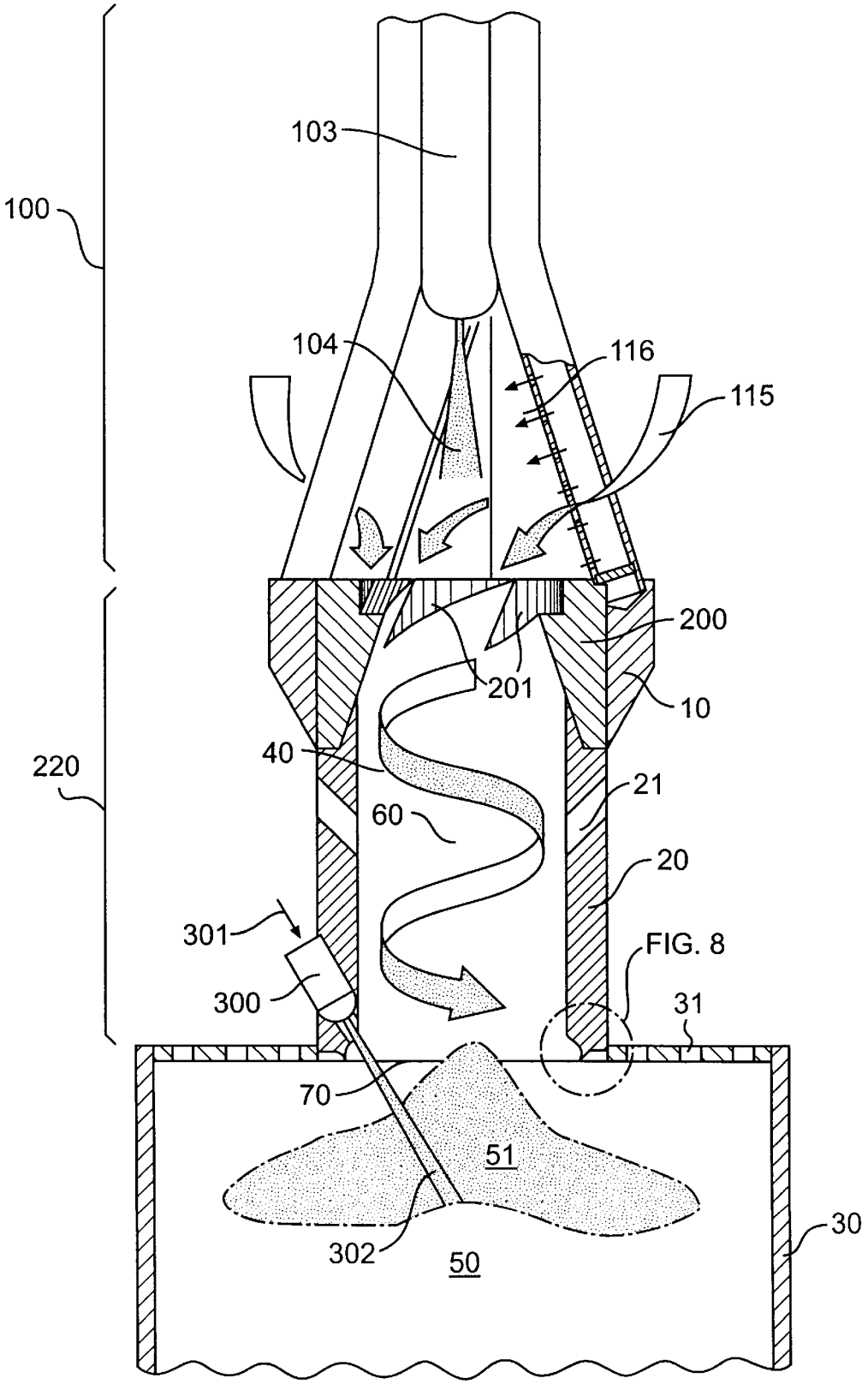
FIG. 1 shows a burner designed as a premix burner and having a mixing section downstream of a swirl generator and means for the flame stabilization.

FIG. 1 shows the overall construction of a burner which is operated as a premix burner. Initially a swirl generator 100 is effective, the configuration of which is shown and described in more detail below in FIGS. 3–6. This swirl generator 100 is a conical structure to which an inflowing combustion-air flow 115 is repeatedly admitted tangentially. The flow forming therein, with the aid of a transition geometry provided downstream of the swirl generator 100, is passed smoothly into a transition piece 200 in such a way that no separation regions can occur there. The configuration of this transition geometry is described in more detail with reference to FIG. 6. This transition piece 200 is extended on the outflow side of the transition geometry by a mixing tube 20, both parts forming the actual mixing section 220. The mixing section 220 may of course be made in one piece; i.e. the transition piece 200 and the mixing tube 20 are then fused to form a single cohesive structure, although the characteristics of each part are retained. If transition piece 200 and mixing tube 20 are constructed from two parts, these parts are connected by a sleeve ring 10, the same sleeve ring 10 serving as an anchoring surface for the swirl generator 100 on the head side. In addition, such a sleeve ring 10 has the advantage that various mixing tubes can be used. Located on the outflow side of the mixing tube 20 is the actual combustion space 30 of a combustion chamber, which is symbolized here merely by a flame tube. The mixing section 220 largely fulfills the task of providing a defined section, in which perfect premixing of fuels of various types can be achieved, downstream of the swirl generator 100. Furthermore, this mixing section, that is primarily the mixing tube 20, enables the flow to be directed free of losses so that at first no backflow zone or backflow bubble can form even in interaction with the transition geometry, whereby the mixing quality for all types of fuel can be influenced over the length of the mixing section 220. However, this mixing section 220 has yet another property, which includes in the fact that, in the mixing section 220 itself, the axial velocity profile has a pronounced maximum on the axis, so that a backflash of the flame from the combustion chamber is not possible. However, it is correct to say that this axial velocity decreases toward the wall in such a configuration. In order also to prevent backflash in this region, the mixing tube 20 is provided in the flow and peripheral directions with a number of regularly or irregularly distributed bores 21 having widely differing cross sections and directions, through which an air quantity flows into the interior of the mixing tube 20 and induces an increase in the rate of flow along the wall for the purposes of a prefilmer. These bores 21 may also be designed in such a way that effusion cooling also appears at least in addition at the inner wall of the mixing tube 20. An additional possibility of increasing the velocity of the mixture inside the mixing tube 20 is for the cross section of flow of the mixing tube 20 on the outflow side of the transition passages 201, which form the transition geometry already mentioned, to undergo a convergence, as a result of which the entire velocity level inside the mixing tube 20 is raised. In the figure, the bores 21 run at an acute angle relative to the burner axis 60. Other courses of these bores 21 are also possible. Furthermore, it is possible to provide the mixing tube 20 intermittently with such bores, for example at the start and at the end of the same. These bores 21 are preferably distributed over the periphery of the mixing tube. Furthermore, the outlet of the transition passages 201 corresponds to the narrowest cross section of flow of the mixing tube 20. Said transition passages 201 accordingly bridge the respective difference in cross section without at the same time adversely affecting the flow formed. If the measure selected initiates an intolerable pressure loss when directing the tube flow 40 along the mixing tube 20, this may be remedied by a diffuser (not shown in the figure) being provided at the end of this mixing tube 20. A combustion chamber 30 (combustion space) then adjoins the end of the mixing tube 20, there being a jump in cross section, formed by a burner front, between the two cross sections of flow. Not until here does a central flame front having a backflow zone 51 form, which backflow zone 51 has the properties of a bodiless flame retention baffle relative to the flame front. If a fluidic marginal zone, in which vortex separations arise due to the vacuum prevailing there, forms inside this jump in cross section during operation, this leads to intensified ring stabilization of the backflow zone 51. In addition, it must not be left unmentioned that the generation of a stable backflow zone 51 also requires a sufficiently high swirl coefficient in a tube. If such a high swirl coefficient is undesirable at first, stable backflow zones may be generated by the feed of small, intensely swirled air flows at the tube end, for example through tangential openings. It is assumed here that the air quantity required for this is approximately 5–20% of the total air quantity. As far as the configuration of the burner outlet at the end of the mixing tube 20 for the spatial stabilization and management of the backflow zone 51 is concerned, reference is made to the description with respect to FIG. 8.

Arranged in the bottom region of the mixing tube 20 in the peripheral direction is at least one fuel lance 300, which is fed with a fuel 301 having a good ignition quality, for example fuel oil. The shorter self-ignition delay time of the liquid fuel 301 ensures that the burner operated with a fuel 116 having a poor ignition quality stabilizes the reaction zone 50 in the combustion space 30, in particular the backflow zone 51. For this purpose, the fuel 301 having a good ignition quality is used as and when required for a low-pollution and lean operation. This is always the case when there is a risk of a backflash of the flame occurring. Injection 302 of fuel into the reaction zone of the backflow zone 51 or respectively into the reaction zone 50 is then carried out via the fuel lance 300. The abovementioned risk of a backflash of the flame into the premix section acting upstream is thus eliminated, since no aerodynamic stabilizing is effected in this reaction zone 50. The flow velocity is also reduced in this reaction zone 50 due to the widening of cross section relative to the cross section of flow of the mixing tube 20, so that, under all desired operating conditions, the retention time of the mixture, originating from the premix section, of combustion air 115 and fuel 116 having a poor ignition quality exceeds the ignition delay time of the fuel 301 having a good ignition quality and injected into the reaction zone 50 and thus achieves the desired stabilization of the flame front and the prevention of a backflash of the flame into the premix section. In addition, it is possible under certain operating conditions to introduce the fuel having a good ignition quality into the swirl zone, although in such a case care has to be taken to ensure that the aerodynamic properties of the swirled flow remain intact.

Figure 2:
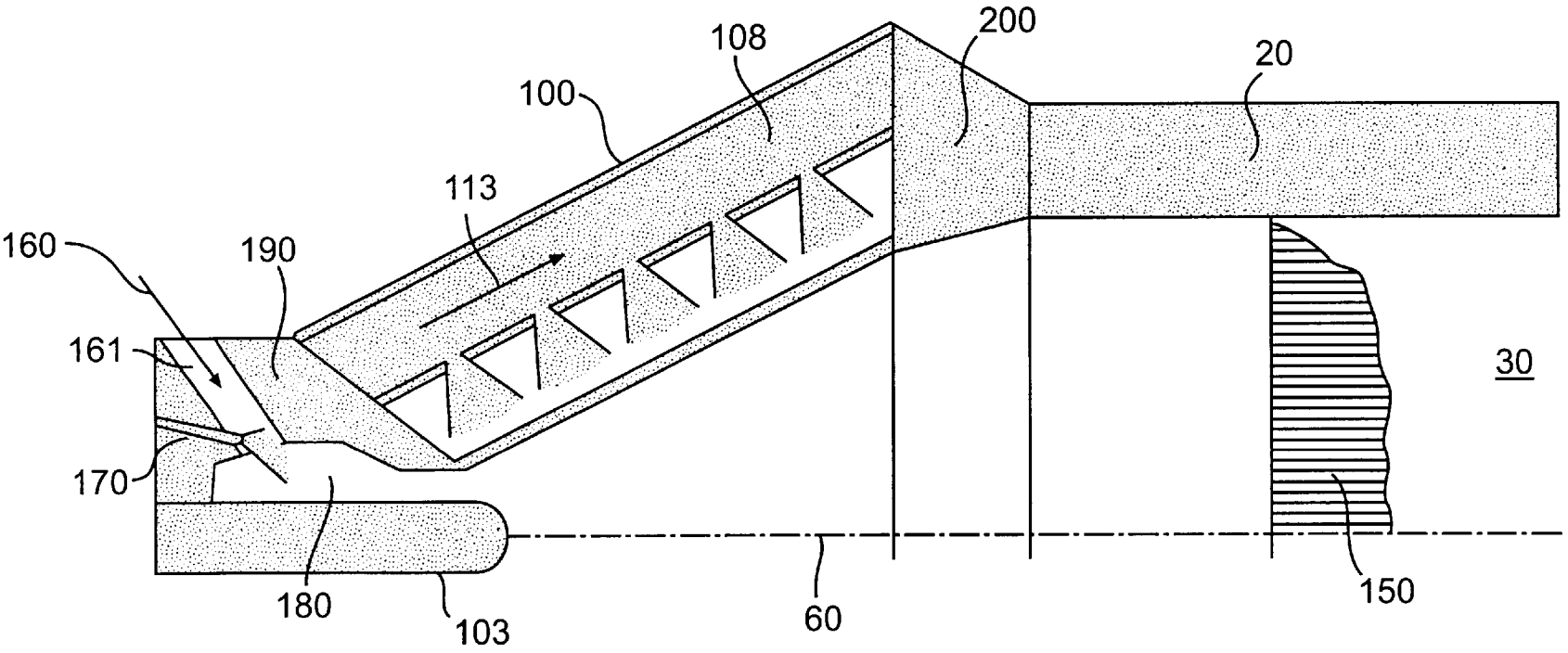
FIG. 2 shows a schematic representation of the burner according to FIG. 1 with the disposition of the additional fuel injectors.

FIG. 2 shows a schematic view of the burner according to FIG. 1, reference being made here in particular to the purging around a centrally arranged fuel nozzle 103 and to the action of fuel injectors 170. The mode of operation of the remaining main components of the burner, namely swirl generator 100 and transition piece 200, are described in more detail with reference to the following figures. The fuel nozzle 103 is encased at a distance by a ring 190 in which a number of bores 161 disposed in the peripheral direction are placed, and an air quantity 160 flows through these bores 161 into an annular chamber 180 and there performs the purging of the fuel nozzle 103. These bores 161 are positioned so as to slant forward in such a way that an appropriate axial component is obtained on the burner axis 60. Provided in interaction with these bores 161 are additional fuel injectors 170 which feed a certain quantity of a preferably gaseous fuel into the respective air quantity 160 in such a way that an even fuel concentration 150 appears in the mixing tube 20 over the cross section of flow, as the representation in the figure is intended to symbolize. It is precisely this even fuel concentration 150, in particular the pronounced concentration on the burner axis 60, which provides for stabilization of the flame front at the outlet of the burner to occur, whereby the occurrence of combustion-chamber pulsations is avoided.

Figure 3:
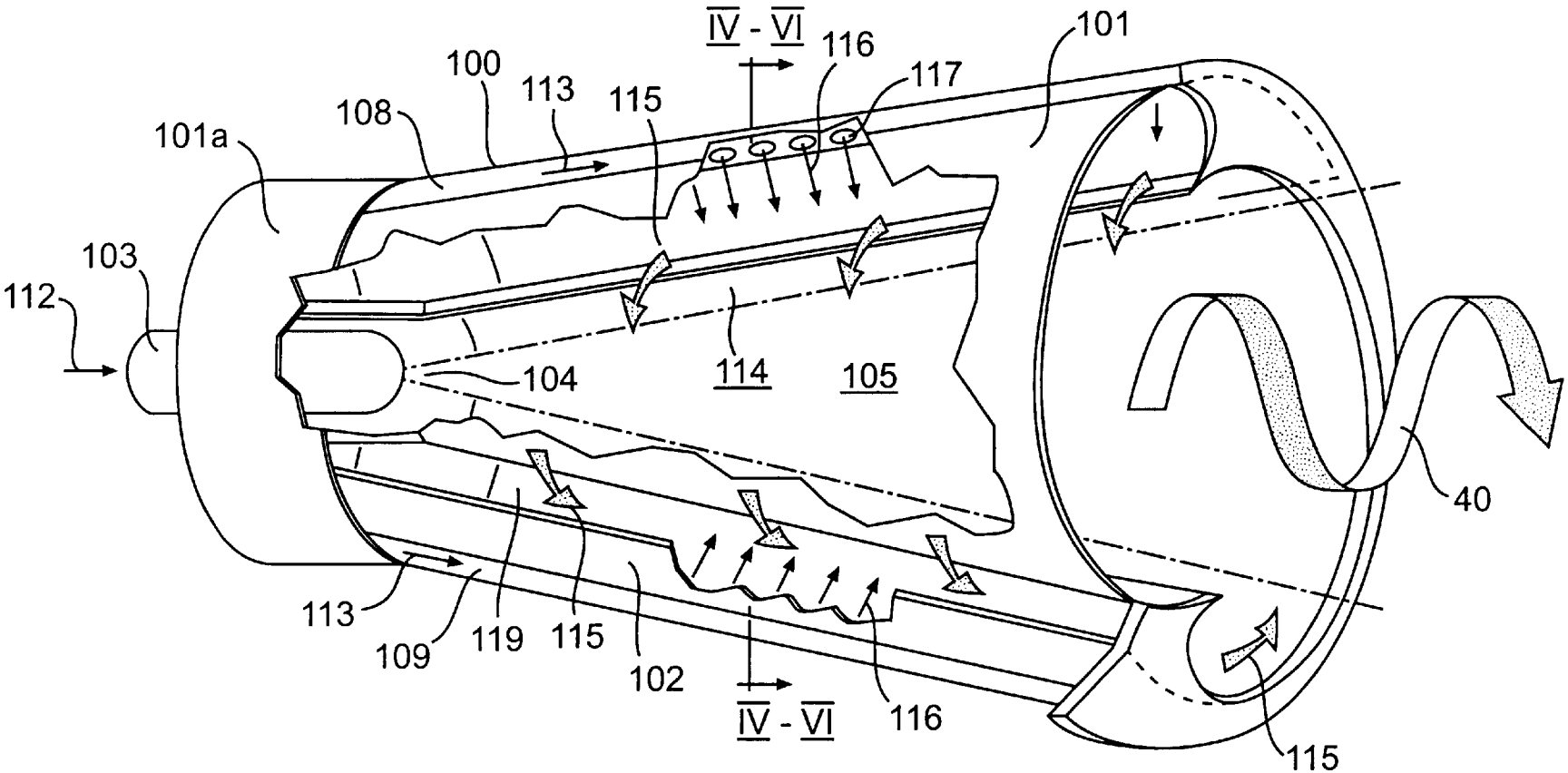
FIG. 3 shows a perspective representation of a swirl generator consisting of a plurality of shells, in appropriate cut-away section.
Figure 4:
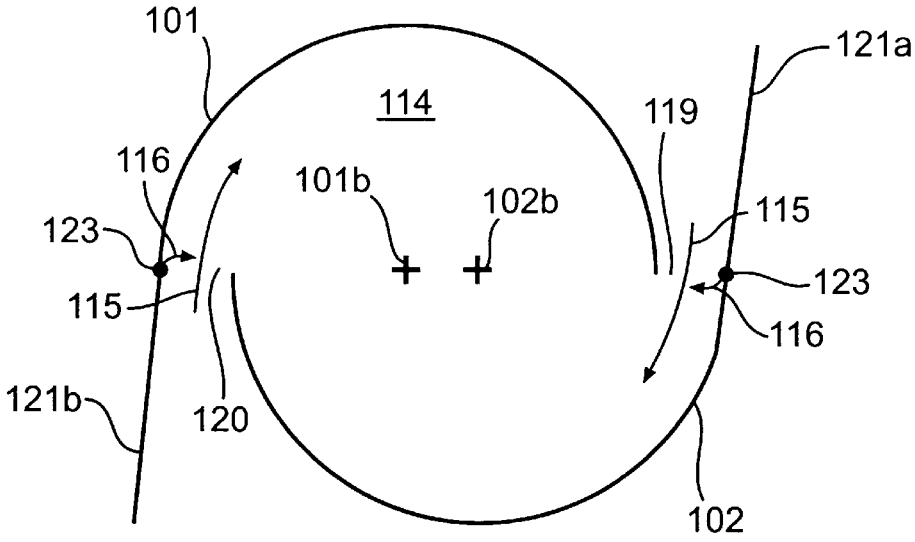
FIG. 4 shows a cross section through a two-shell swirl generator.

In order to better understand the construction of the swirl generator 100, it is of advantage if at least FIG. 4 is used at the same time as FIG. 3. In the description of FIG. 3 below, the remaining figures are referred to when required.

Figure 5:
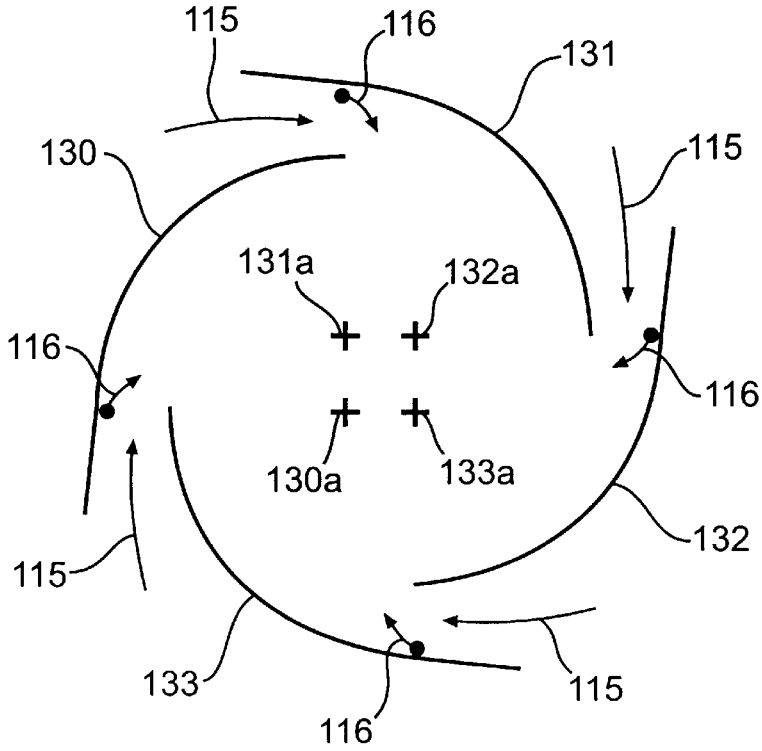
FIG. 5 shows a cross section through a four-shell swirl generator.
Figure 6:
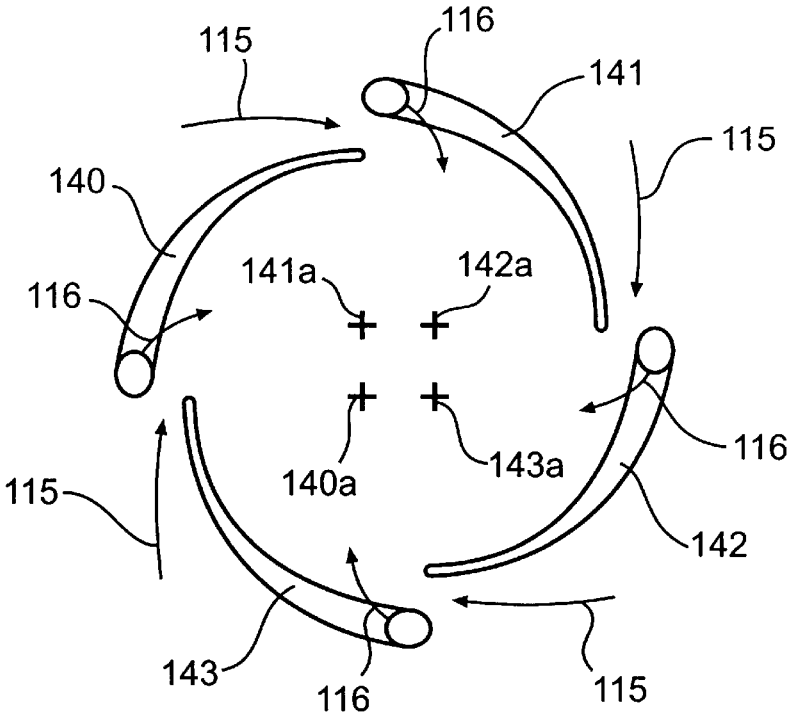
FIG. 6 shows a view through a swirl generator whose shells are profiled in a blade shape.

The first part of the burner according to FIG. 1 forms the swirl generator 100 shown according to FIG. 3. The swirl generator 100 consists of two hollow conical sectional bodies 101, 102 which are nested one inside the other in a mutually offset manner. The number of conical sectional bodies may of course be greater than two, as FIGS. 5 and 6 show; this depends in each case on the mode of operation of the entire burner, as will be explained in more detail further below. It is not out of the question in certain operating configurations to provide a swirl generator consisting of a single spiral. The mutual offset of the respective center axis or longitudinal symmetry axes 101*b*, 102*b* (cf. FIG. 4) of the conical sectional bodies 101, 102 provides at the adjacent wall, in mirror-image arrangement, one tangential inflow duct each, i.e. an air-inlet slot 119, 120 (cf. FIG. 4) through which the combustion air 115 flows into the interior space of the swirl generator 100, i.e. into the conical hollow space 114 of the same. The conical shape of the sectional bodies 101, 102 shown has a certain fixed angle in the direction of flow. Of course, depending on the operational use, the sectional bodies 101, 102 may have increasing or decreasing conicity in the direction of flow, similar to a trumpet or tulip respectively. The two last-mentioned shapes are not shown graphically, since they can readily be visualized by a person skilled in the art. The two conical sectional bodies 101, 102 each have a cylindrical annular initial part 101*a*. Accommodated in the region of this cylindrical initial part is the fuel nozzle 103, which has already been mentioned with reference to FIG. 2 and is preferably operated with a liquid fuel 112. The injection 104 of this fuel 112 coincides approximately with the narrowest cross section of the conical hollow space 114 formed by the conical sectional bodies 101, 102. The injection capacity of this fuel nozzle 103 and its type depend on the predetermined parameters of the respective burner. Furthermore, the conical sectional bodies 101, 102 each have a fuel line 108, 109, and these fuel lines 108, 109 are arranged along the tangential air-inlet slots 119, 120 and are provided with injection openings 117 through which preferably a gaseous fuel 113 is injected into the combustion air 115 flowing through there, as the arrows 116 are intended to symbolize. These fuel lines 108, 109 are preferably arranged at the latest at the end of the tangential inflow, before entering the conical hollow space 114, in order to obtain optimum fuel/air mixing. As mentioned, the fuel 112 fed through the fuel nozzle 103 is a liquid fuel in the normal case, a mixture formation with another medium, for example with a recycled flue gas, being readily possible. This fuel 112 is injected at a preferably very acute angle into the conical hollow space 114. Thus a conical fuel spray 105, which is enclosed and reduced by the rotating combustion air 115 flowing in tangentially, forms from the fuel nozzle 103. The concentration of the injected fuel 112 is then continuously reduced in the axial direction by the inflowing combustion air 115 to form a mixture in the direction of vaporization. If a gaseous fuel 113 is introduced via the opening nozzles 117, the fuel/air mixture is formed directly at the end of the air-inlet slots 119, 120. If the combustion air 115 is additionally preheated or, for example, enriched with recycled flue gas or exhaust gas, this provides lasting assistance for the vaporization of the liquid fuel 112, before this mixture flows into the downstream stage, here into the transition piece 200 (cf. FIGS. 1 and 7). The same considerations also apply if liquid fuels are to be supplied via the lines 108, 109. Narrow limits per se are to be adhered to in the configuration of the conical sectional bodies 101, 102 with regard to the cone angle and the width of the tangential air-inlet slots 119, 120 so that the desired flow field of the combustion air 115 can develop at the outlet of the swirl generator 100. In general it may be said that a reduction in the size of the tangential air-inlet slots 119, 120 promotes the quicker formation of a backflow zone already in the region of the swirl generator. The axial velocity inside the swirl generator 100 can be increased or stabilized by a corresponding feed of an air quantity, this feed being described in more detail with reference to FIG. 2 (item 160). Corresponding swirl generation in interaction with the downstream transition piece 200 (cf. FIGS. 1 and 7) prevents the formation of flow separations inside the mixing tube arranged downstream of the swirl generator 100. Furthermore, the design of the swirl generator 100 is especially suitable for changing the size of the tangential air-inlet slots 119, 120, whereby a relatively large operational range can be covered without changing the overall length of the swirl generator 100. The sectional bodies 101, 102 may of course also be displaced relative to one another in another plane, as a result of which even an overlap of the same can be provided. Furthermore, it is possible to nest the sectional bodies 101, 102 spirally one inside the other by a contra-rotating movement. It is thus possible to vary the shape, size and configuration of the tangential air-inlet slots 119, 120 as desired, whereby the swirl generator 100 can be used universally without changing its overall length.

Inter alia, the geometric configuration of baffle plates 121*a*,121*b*, which may be provided as desired, is apparent from FIG. 4. They have a flow-initiating function, in which case, in accordance with their length, they extend the respective end of the conical sectional bodies 101, 102 in the incident-flow direction relative to the combustion air 115. The ducting of the combustion air 115 into the conical hollow space 114 can be optimized by opening or closing the baffle plates 121*a*, 121*b* about a pivot 123 placed in the region of the inlet of this duct into the conical hollow space 114, and this is especially necessary if the original gap size of the tangential air-inlet slots 119, 120 is to be changed dynamically, for example in order to change the velocity of the combustion air 115. These dynamic measures may of course also be provided statically by baffle plates forming as and when required a fixed integral part with the conical sectional bodies 101, 102.

FIG. 5, in comparison with FIG. 4, shows that the swirl generator 100 is now composed of four sectional bodies 130, 131, 132, 133. The associated longitudinal symmetry axes for each sectional body are identified by the letter a. It may be said of this configuration that, on account of the smaller swirl intensity thus produced, and in interaction with a correspondingly increased slot width, it is best suited to prevent the breakdown of the vortex flow on the outflow side of the swirl generator in the mixing tube, whereby the mixing tube can best fulfill the role intended for it.

FIG. 6 differs from FIG. 5 inasmuch as the sectional bodies 140, 141, 142, 143 here have a blade-profile shape, which is provided for supplying a certain flow. Otherwise, the mode of operation of the swirl generator is the same. The admixing of the fuel 116 into the combustion-air flow 115 is effected from the interior of the blade profiles, i.e. the fuel line 108 is now integrated in the individual blades. Here, too, the longitudinal symmetry axes for the individual sectional bodies are identified by the letter a.

Figure 7:
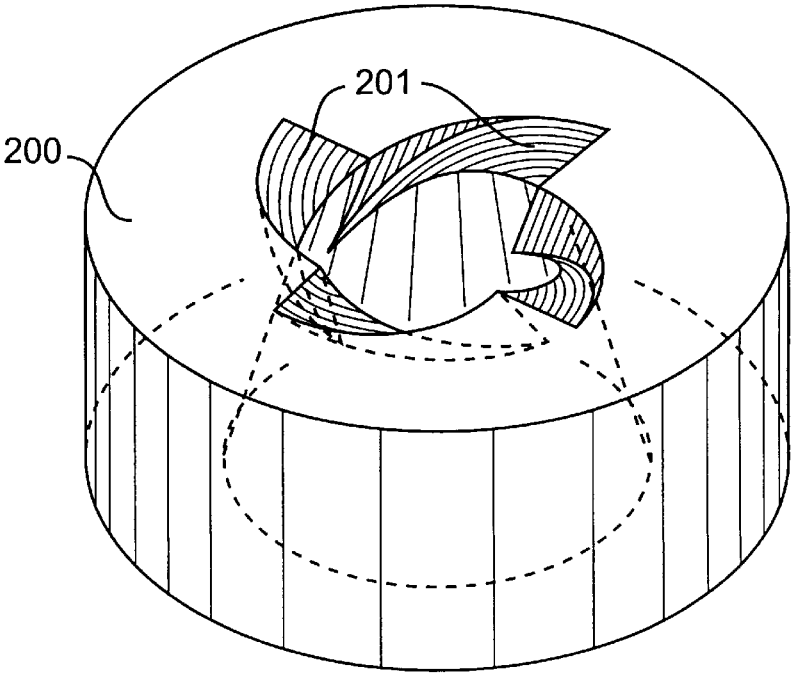
FIG. 7 shows a configuration of the transition geometry between swirl generator and mixing section.

FIG. 7 shows the transition piece 200 in a three-dimensional view. The transition geometry is constructed for a swirl generator 100 having four sectional bodies in accordance with FIGS. 5 or 6. Accordingly, the transition geometry has four transition passages 201 as a natural extension of the sectional bodies acting upstream, as a result of which the cone quadrant of said sectional bodies is extended until it intersects the wall of the mixing tube. The same considerations also apply when the swirl generator is constructed from a principle other than that described with reference to FIG. 3. The surface of the individual transition passages 201 which runs downward in the direction of flow has a form which runs spirally in the direction of flow and describes a crescent-shaped path, in accordance with the fact that in the present case the cross section of flow of the transition piece 200 widens conically in the direction of flow. The swirl angle of the transition passages 201 in the direction of flow is selected in such a way that a sufficiently large section subsequently remains for the tube flow up to the jump in cross section at the combustion-chamber inlet in order to effect perfect premixing with the injected fuel. Furthermore, the axial velocity at the mixing-tube wall downstream of the swirl generator is also increased by the abovementioned measures. The transition geometry and the measures in the region of the mixing tube produce a distinct increase in the axial-velocity profile toward the center of the mixing tube, so that the risk of premature ignition is decisively counteracted.

Figure 8:
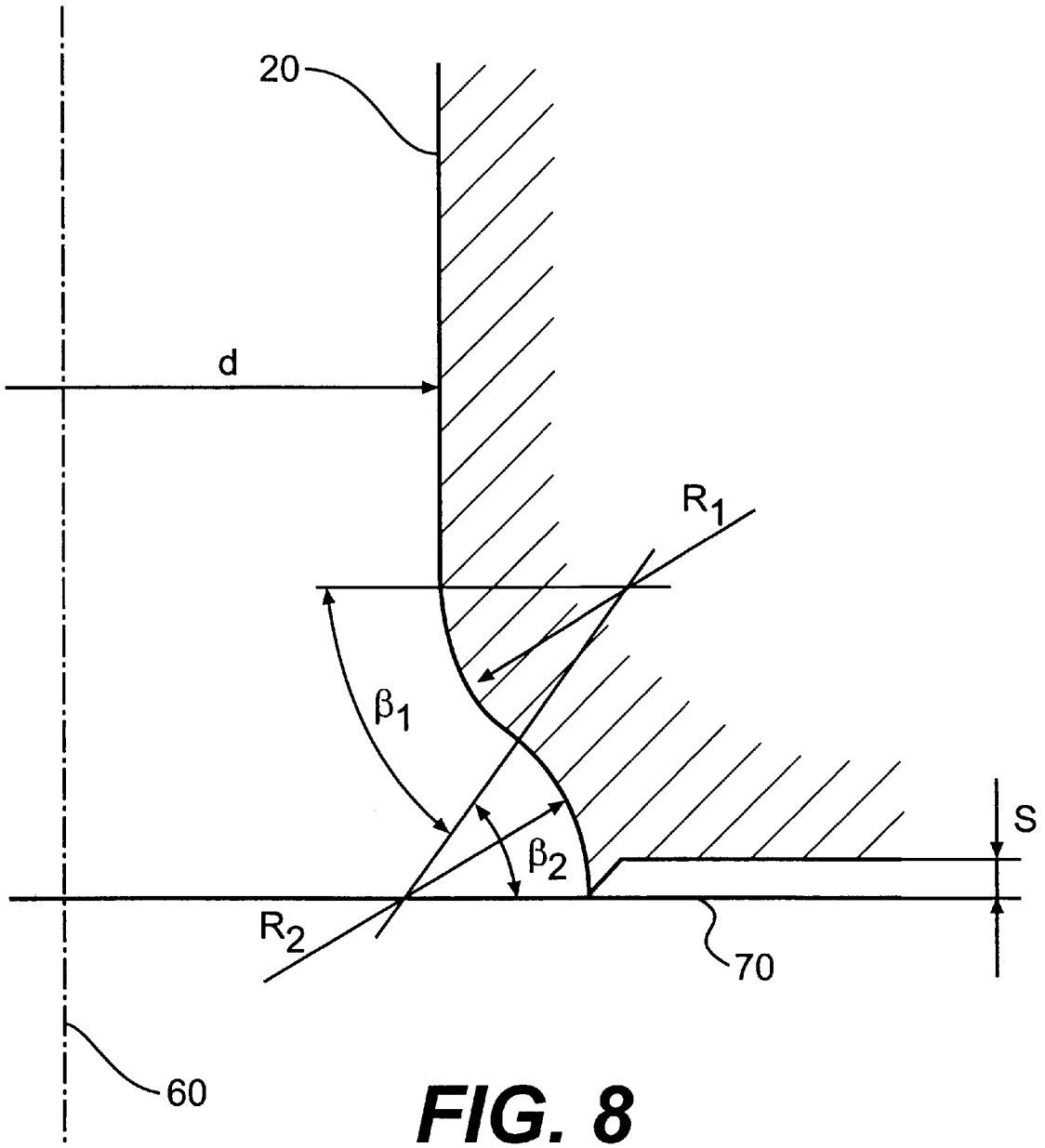
FIG. 8 shows a configuration of the burner outlet for the spatial management of the backflow zone.

FIG. 8 shows the geometrical configuration, already discussed, of the burner outlet at the end of the mixing tube 20 for the spatial stabilization of the backflow zone. In this region the cross section of flow of the tube 20 is given a first transition radius $R_1$ which is convex relative to the burner axis 60 and the size of which in principle depends on the respective flow inside the mixing tube 20. The size of this radius $R_1$ is accordingly selected in such a way that the flow comes into contact with the wall and thus causes the swirl coefficient to increase considerably. Quantitatively, the size of the radius $R_1$ can be defined in such a way that it is >10% of the inside diameter d of the mixing tube 20. Compared with a flow without a radius, the backflow zone 51 is now hugely enlarged. This radius $R_1$ then merges into a second radius $R_2$ which runs concavely relative to the burner axis 60 up to the outlet plane 70 of the mixing tube 20, the size of this radius $R_2$ being >10% of the inside diameter d of the mixing tube 20. This second radius $R_2$ ensures that the marginal flow is axially oriented in such a way that the flame, if the combustion chamber has a small radial extent, does not strike the combustion-chamber wall. The sectorial angles $\beta_1$ and $\beta_2$ of the two radii $R_1$, $R_2$ are complementary angles, the maximum sum of which is 90°. Depending on the swirl coefficient and the axial orientation of the flow, the two angles referred to undergo a corresponding adaptation, which is interdependent with respect to the size of the two radii. Furthermore, the outlet plane 70 of the mixing tube 20 is provided with a step S of >3 mm depth from the end edge of the second radius $R_2$ in the radial direction, this step performing the function of a flow-breakaway step.

Obviously, numerous modifications and variations of the present invention are possible in light of the above teachings. It is therefore to be understood that, within the scope of the appended claims, the invention may be practiced otherwise than as specifically described herein.

What is claimed as new and desired to be secured by Letters Patent of the United States is:

1. A method of operating a burner of a heat generator, the burner comprising a swirl generator for providing a combustion-air flow and means for injecting at least one first fuel into the combustion-air flow, a mixing section arranged downstream of the swirl generator, said mixing section including a first part having a number of transition passages for passing a flow formed in the swirl generator into a mixing tube arranged downstream of the transition passages, a combustion-air/fuel mixture being obtained in the mixing tube, a combustion space formed by a widening of cross section and having a reaction zone arranged downstream of the mixing tube, in which reaction zone the combustion of a combustion-air/fuel mixture takes place, said method comprising:

injecting a predetermined quantity of a second fuel having a good ignition quality into the reaction zone in order to stabilize the combustion of the combustion-air/fuel mixture in the combustion space.

2. The burner of a heat generator, the burner comprising:

a swirl generator for a combustion-air flow and means for injecting at least one fuel into the combustion-air flow, a mixing section arranged downstream of the swirl generator, said mixing section including a first part having a number of transition passages for passing a flow formed in the swirl generator into a mixing tube arranged downstream of these transition passages, a combustion-air/fuel mixture being obtained in the mixing tube, a combustion space formed by a widening of cross section and having a reaction zone arranged downstream of the mixing tube, in which reaction zone the combustion of a combustion-air/fuel mixture takes place, wherein the burner, in order to stabilize the combustion, further comprises at least one further fuel lance, fed with a fuel having a good ignition quality, a predetermined amount of the fuel having a good ignition quality being directed into the reaction zone.

3. The burner as claimed in claim 2, wherein the swirl generator comprises at least two hollow, conical sectional bodies which are nested one inside the other in the direction of flow, wherein the respective longitudinal symmetry axes of these sectional bodies run mutually offset in such a way that the adjacent walls of the sectional bodies form ducts, tangential in their longitudinal extent, for the combustion-air flow, and wherein there is at least one fuel nozzle in an interior space formed by the sectional bodies.

4. The burner as claimed in claim 3, wherein further fuel nozzles are arranged in the region of the tangential ducts in their longitudinal extent.

5. The burner as claimed in claim 3, wherein the sectional bodies have a blade-shaped profile in cross section.

6. The burner as claimed in claim 3, wherein the sectional bodies have at least one of a fixed cone angle, increasing conicity, or decreasing conicity in the direction of flow.

7. The burner as claimed in claim 5, wherein the sectional bodies are nested spirally one inside the other.

8. The burner as claimed in claim 2, wherein the number of transition passages in the mixing section corresponds to the number of partial flows formed by the swirl generator.

9. The burner as claimed in claim 2, wherein the mixing tube is provided in the flow and peripheral directions with bores for injecting an air flow into an interior.

10. The burner as claimed in claim 9, wherein the bores run at an acute angle relative to an axis of the mixing tube.

11. The burner as claimed in claim 2, wherein the cross section of flow of the mixing tube downstream of the transition passages is less than, equal to or greater than the cross section of the flow formed in the swirl generator.

12. The burner as claimed in claim 2, wherein there is an increase in cross section between the mixing section and the combustion space, which increase in cross section induces the initial cross section of flow of the combustion chamber, and wherein a backflow zone can take effect in the region of the increase in cross section.

13. The burner as claimed in claim 2, further including at least one of a diffuser and a venturi section upstream of a first radius of the mixing tube.

14. The burner as claimed in claim 2, wherein, at the end of the mixing tube in its region leading out to the downstream combustion space, the mixing tube has a first radius which runs convexly relative to a burner axis, wherein the first radius merges into a second radius which extends up to an outlet plane of the mixing tube and runs concavely relative to the burner axis, and wherein a covered sector of the two radii is less than or equal to 90°.

15. The burner as claimed in claim 14, wherein the two radii are in each case greater than 10% of an inside diameter of the mixing tube.

16. The burner as claimed in claim 14, wherein the outlet plane is provided with a step in the radial direction from an end edge of the second radius.

17. The burner as claimed in claim 16, wherein the step has a depth of greater than 3 mm.

* * * * *